US007363792B2

(12) United States Patent
Modrow et al.

(10) Patent No.: US 7,363,792 B2
(45) Date of Patent: Apr. 29, 2008

(54) APPARATUS FOR MANUFACTURING METAL MATERIAL BY ROLLING

(75) Inventors: Wilfried Modrow, Solingen (DE); Ulrich Skoda-Dopp, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 11/578,810

(22) PCT Filed: Dec. 16, 2005

(86) PCT No.: PCT/EP2005/013546

§ 371 (c)(1),
(2), (4) Date: Oct. 19, 2006

(87) PCT Pub. No.: WO2006/063839

PCT Pub. Date: Jun. 22, 2006

(65) Prior Publication Data

US 2007/0180882 A1 Aug. 9, 2007

(30) Foreign Application Priority Data

Dec. 18, 2004 (DE) ..... 10 2004 061 081
Nov. 5, 2005 (DE) ..... 10 2005 052 815

(51) Int. Cl.
*B21B 41/00* (2006.01)

(52) U.S. Cl. ..... 72/227; 72/201; 72/206; 72/229; 72/251

(58) Field of Classification Search ..... 72/200, 72/201, 202, 206, 226, 227, 228, 229, 234, 72/250, 251
See application file for complete search history.

(56) References Cited

U.S. PATENT DOCUMENTS 4,675,974 A 6/1987 Connolly et al.
5,636,543 A * 6/1997 Kajiwara et al. ..... 72/234
5,689,991 A * 11/1997 Kircher ..... 72/202
6,026,669 A * 2/2000 Ginzburg ..... 72/229
6,182,490 B1 * 2/2001 Ginzburg et al. ..... 72/229
6,309,482 B1 10/2001 Dorricott et al.
6,568,234 B2 * 5/2003 Shore ..... 72/228
6,722,174 B1 * 4/2004 Nishii et al. ..... 72/41

FOREIGN PATENT DOCUMENTS

EP 0 662 358 7/1995
EP 0 937 512 8/1999

* cited by examiner

*Primary Examiner*—Ed Tolan
(74) *Attorney, Agent, or Firm*—Friedrich Kueffner

(57) ABSTRACT

The invention relates to a device for producing a metallic product (1) by rolling, comprising: a first area (2) inside of which slabs are produced by primary shaping; a second area (3), which is located downstream from the first area (2) in the direction of flow (F) of the material and inside of which at least one first rolling device (4) for rolling slabs is arranged; a third area (5), which is located downstream from the second area (3) in the direction of flow (F) of the material and inside of which at least one second rolling device (6) for rolling slabs or the intermediate product produced therefrom is arranged, and; a fourth area (7), which is located downstream from the third area (5) in the direction of flow (F) of the material and inside of which at least one aftertreating device (8) for the rolled material is arranged. In order to increase the economic efficiency of the device, this device is characterized by (having a conveying device (9) with which the metallic product (1) can be removed between the second area (3) and the third area (5), conveyed and can be fed to the processing process once again between the third area (5) and the fourth area (7).

10 Claims, 2 Drawing Sheets

APPARATUS FOR MANUFACTURING METAL MATERIAL BY ROLLING

This appication is a 35 USC 371 of PCT/EP05/13546, filed Dec. 16, 2005.

The invention concerns an installation for producing rolled metal product, which has: a first zone, in which slabs are produced by primary forming; a second zone downstream of the first zone in the direction of flow of the material, in which at least a first rolling installation is installed for rolling the slabs; a third zone downstream of the second zone in the direction of flow of the material, in which at least a second rolling installation is installed for rolling the slabs or the intermediate product produced from them; and a fourth zone downstream of the third zone in the direction of flow of the material, in which at least one installation for further processing of the rolled material is installed.

Rolling installations of this type are sufficiently well known in the prior art. For example, flat stock made of steel and/or nonferrous materials in sheet and/or strip form can be produced in these installations. In a continuous casting installation, a metal strand can be cast, which is passed through a roughing mill (first rolling installation) and then through a finishing mill (second rolling installation), in which the product is rolled from the slab and is finished with respect to its geometry. This is followed by further processing of the rolled product, especially cooling, coiling, and possibly hot straightening.

In the roughing mill, the slab can first be heated in a furnace to rolling temperature and can then be rolled out to the desired sheet dimensions in a single-stand or multiple-stand rolling mill by means of a rolling sequence, which can also include a 90° rotation of the rolling stock. Special turning equipment for the material to be rolled is described, for example, in DE-OS 14 52 161 and DE-OS 16 52 560.

Steckel mill rolling has proven to be an especially advantageous rolling process in the finishing mill. The Steckel mill has a first hot box, which is located in an upstream position with respect to the direction of flow of the material, and a second hot box located in a downstream position. In regard to this technology, the reader is referred to WO 96/40456, WO 96/41024, and WO 00/03042, which describe the Steckel rolling process. In this process, for example, long continuously cast slabs are rolled out to long end lengths without turning in a Steckel mill by coiling the rolling stock between the finishing passes in heated Steckel hot boxes. After the last pass, the long end lengths are optionally coiled into coils or cut into individual sheets by a shear. The individual sheets can be cooled and straightened as part of this process.

The Steckel rolling process has various advantages in the processing of a roughed slab into metal strip. One advantage that deserves special mention is that the process of rolling out the slab to a relatively thin strand can be carried out in a relatively small space.

However, the process also has the disadvantage that it takes a relatively long time to carry out the numerous passes in the Steckel mill. The Steckel mill part of the finishing installation is thus often the rate-determining part of the installation, on which the throughput and thus the economy of the plant depends.

Therefore, the objective of the invention is further development of an installation of the aforementioned type that makes it possible to achieve greater plant economy, especially when the Steckel rolling process is used.

The solution to this problem in accordance with the invention is characterized by a conveyance system with which the metal stock can be removed between the second zone and the third zone of the installation, conveyed, and then returned to the treatment process between the third zone and the fourth zone of the installation.

The idea of the invention is thus to utilize only the first rolling installation (i.e., the roughing mill) for the purpose of using the production plant while dispensing with rolling in the second rolling installation (i.e., the finishing mill), and then (in order to be able to use the further processing installation for the rolling stock that has been rolled only in the first rolling installation) to convey the roughed material around and parallel to the second rolling mill and back to the treatment process upstream of the further processing installation.

The second rolling installation is preferably a Steckel mill, which has at least one rolling stand with a first hot box upstream and a second hot box downstream of the stand in the direction of flow of the metal rolling stock. In other words, the Steckel rolling process is carried out in this installation.

The further processing installation is preferably a cooling installation for the rolled product.

The conveyance system for bypassing the second rolling installation, i.e., especially the Steckel mill, can have a roller table that is arranged parallel to the second rolling installation. In addition, the conveyance system can have at least one and preferably two devices with which metal rolling stock can be conveyed transversely to the direction of flow of the material. In this way, the material roughed in the first rolling installation can be conveyed directly from the first rolling installation to the further processing installation in the manner of a bypass.

It is advantageous for the first zone of the installation to have a continuous casting installation. A slab storage area can be located in the first zone or the second zone of the installation. At least one heating furnace (preferably two furnaces) for the material to be rolled is preferably arranged between the slab storage area and the first rolling installation for the purpose of heating the material to the optimum rolling temperature. In addition, a descaling system can be installed between the one or more heating furnaces and the first rolling installation.

Finally, it is advantageous to install a shear downstream of the second hot box of the Steckel mill in the direction of flow of the metal rolling stock.

The economy of the production process can be significantly increased with the above-described design of an installation for the rolling of metal stock, since during the Steckel rolling (in the second rolling installation), the first rolling installation can be used for different rolling stock, which can then be treated directly in the further processing installation.

A specific embodiment of the invention is illustrated in the drawings.

Figure 1:
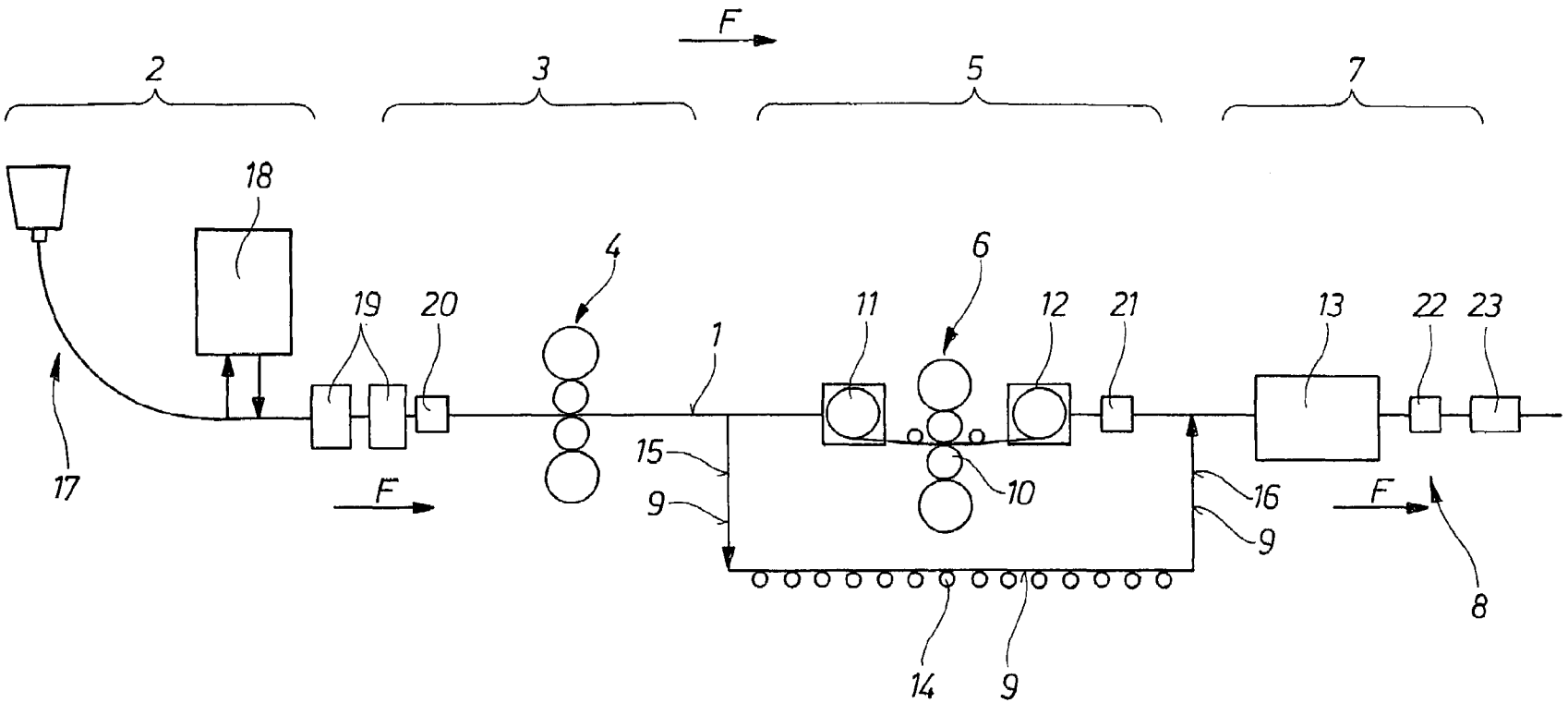
FIG. 1 shows a schematic drawing of an installation for producing a rolled metal product.

FIG. 1 shows a production installation for producing and processing metal rolling stock 1. The installation has essentially four zones 2, 3, 5, and 7, which follow one another in the direction of flow F of the metal rolling stock. The primary forming of the stock 1, i.e., the casting, takes place in the first zone 2, which comprises a continuous casting installation 17, in which strand material is produced by well-known means from molten metal (steel, light metal) and then further processed as slab. In this regard, it can be useful to provide a slab storage area 18 for holding cast slabs downstream of the continuous casting installation 17.

As they are needed, the slabs kept in stock in the slab storage area 18 are conveyed cold or hot or in a combined form to at least one heating furnace 19, in which they are heated to the temperature required for the subsequent rolling operation. After the slab has been discharged from the heating furnace 19, it is descaled in a descaling system 20 (furnace scale sprayer) and fed into the roughing mill.

The roughing mill extends over the second zone 3 of the installation and comprises the first rolling installation 4, which is shown in only a schematic way in FIG. 1. The roughing mill consists of a horizontal rolling stand and possibly a vertical stand and one or two turning devices before or after the stand for turning the slab.

Therefore, metal rolling stock can already be rolled in the first rolling installation 4 in such a way that it is sufficiently shaped for certain applications, so that it is not necessary to carry out an additional rolling operation.

In other words, the slab can be rolled out to well-defined intermediate dimensions with well-defined temperatures in the first rolling installation 4 and then fed to the finishing mill. Alternatively, however, it is also possible to roll out the slab to well-defined final dimensions with well-defined temperatures in the first rolling installation 4 and then to convey it further, as will be described in greater detail below.

If the material that has been roughed in the first rolling installation 4 is to be further rolled, it is conveyed to the third zone 5, which contains a second rolling installation 6. This rolling installation is a Steckel rolling mill, i.e., it has a rolling stand 10 with a first hot box 11 arranged upstream and a second hot box 12 arranged downstream in the direction of flow F.

The Steckel rolling installation can also be followed by a shear 21, which can be used both for cropping the ends of the rolling stock for the Steckel process and as dividing shears after the last finishing pass. FIG. 1 shows a rolling stand 10 schematically. It can also be provided for the finishing mill to have a horizontal stand and a vertical stand. The metal stock 1 is then rolled at well-defined temperatures in the finishing mill to the desired final dimensions, and it is coiled in the hot boxes 11, 12 between the passes. However, it is also possible for the finishing mill to be used without the Steckel process, as in the case of conventional two-stand sheet mills for the finish-rolling of metal sheet.

In each case, i.e., in the case of rolling only in the first rolling installation 4 and in the case of additional rolling in the second rolling installation 6, the rolling is followed by additional treatment of the rolled product in a further processing installation 8, which is located in the fourth zone 7 of the installation.

The further processing installation 8 has a cooling installation 13, in which well-known means are used to bring the rolled and still hot material to a desired temperature according to technological requirements. In the illustrated embodiment, a coiler 22 for coiling the finished strip and a hot straightening machine 23 are additionally provided, so that after the finished product has been cooled in the cooling line, it can either be cooled or further conveyed to the stretcher leveler.

To make it possible, when required, to feed metal product that has been rolled in the first rolling installation 4 directly to the further processing 8 by bypassing the second rolling installation 6, in which other material can be simultaneously processed by the Steckel rolling process, the conveyance system 9 is provided, which constitutes a bypass of the second rolling installation 6 or the third zone 5. Means 15, which are shown only schematically, are used to remove the rolled product leaving the second zone 3 out of the actual processing line and convey it transversely to the direction of flow F. The rolled product is then conveyed in direction of flow F on the roller table 14, which runs parallel to the finishing mill with the second rolling installation 6. At the end of the roller table 14, means 16 are arranged, with which the rolled product 1 is again conveyed transversely to the direction of flow F and back into the actual processing line, so that the material bypasses the third zone 5 and directly enters the further processing installation 8, in which it is cooled in the cooling installation 13 and possibly subjected to other treatment operations (coiling, straightening).

This design makes it possible for the installation and especially the first rolling installation 4 in the second zone 2 and the further processing installation 8 in the fourth zone 7 to be used for the processing and treatment of metal rolling stock, while the relatively time-consuming Steckel rolling process is being carried out in the second rolling installation 6 in the third zone. It is thus possible, while the third zone 5 and especially the Steckel mill (finishing mill) is being used for a relatively long period of time, to carry out a rolling operation in the first rolling installation 4 (roughing mill) with or without cooling pauses for thermomechanical rolling and then to feed the products directly to the further processing installation, e.g., the water-cooling system and/or the hot straightening machine, by bypassing the finishing mill.

Without the proposal of the invention, the first rolling installation 4 and the further processing installation 8 would be largely passive during the Steckel rolling, which would have an adverse effect on the economy of the plant.

Figure 2:
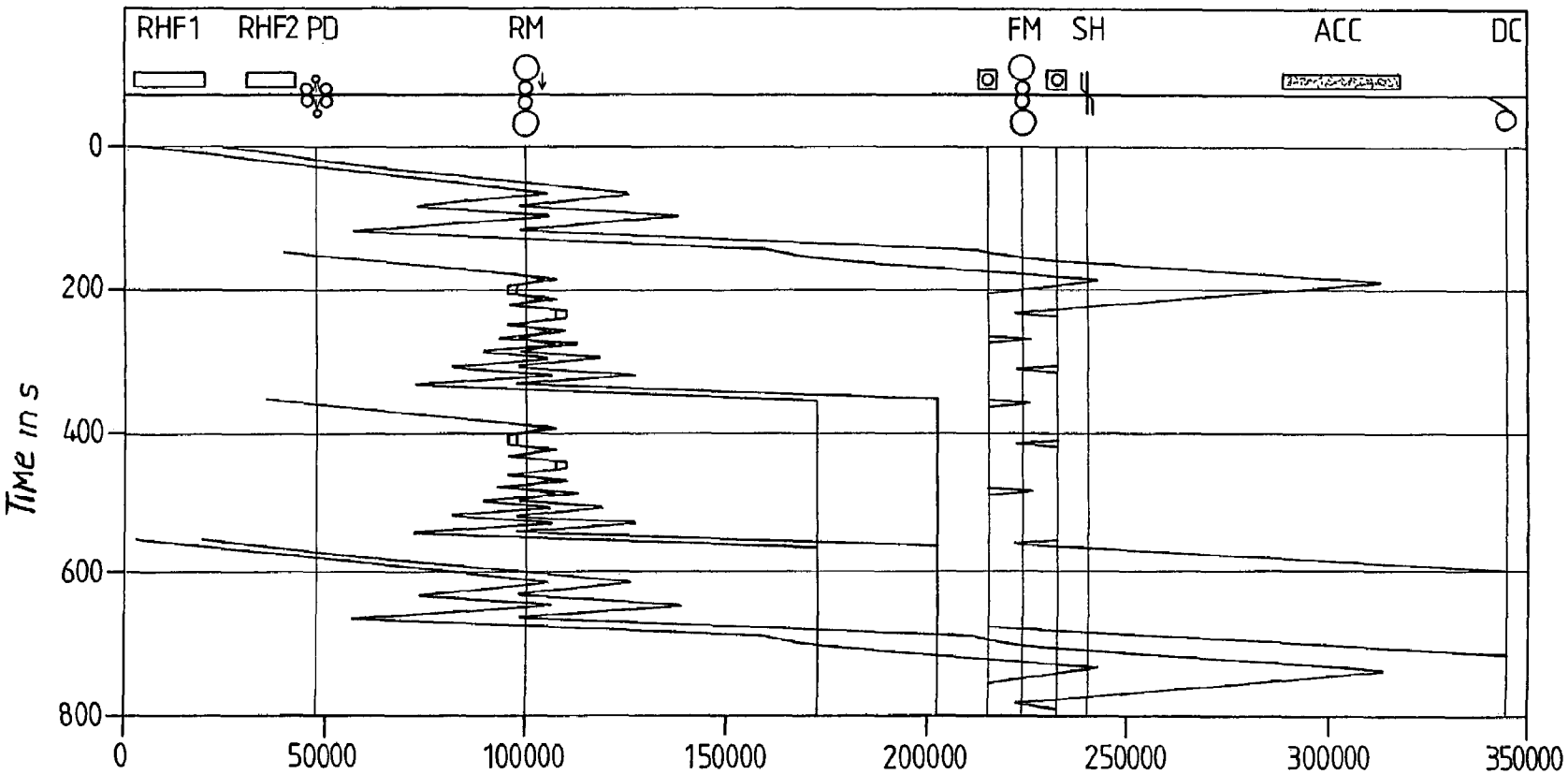
FIG. 2 shows the path-time diagram for metal rolling stock processed with the installation.

A path-time diagram for an actual application is sketched in FIG. 2. The diagram indicates how the metal stock to be processed moves through the rolling mill over time. The flow for each product is reproduced, with each leading end and trailing end shown.

A slab with the dimensions 150 mm×2,500 mm×16 m is heated in a first furnace RHF1 (corresponding to the first heating furnace 19 in FIG. 1) and—after descaling in the device PD—reduced to the near-net strip thickness of 45 mm in a roughing mill RM (corresponding to the first rolling installation 4 in FIG. 1). The roughed slab is then rolled out to the finished strip thickness of 5 mm in the finishing mill FM (corresponding to the second rolling installation 6 in FIG. 1) by the Steckel process. The finishing mill is followed by the shear SH, the cooling line ACC and the coiler DC.

While the finishing mill FM is occupied with the strip rolling, two slabs with the dimensions 250 mm×2,100 mm×2,100 mm, which are heated in a furnace RHF2 (again corresponding to furnace 19 in FIG. 1), can be rolled in the roughing mill RM into plates with dimensions of 10 mm×3,650 mm×30 m in, for example, 15 passes and by means of turning, and they can then be conveyed past the finishing mill FM and to the cooling line ACC (corresponding to the cooling installation 13 in FIG. 1) or to the stretcher leveler by the parallel roller table 9. A strip-rolling operation can then be carried out again in the roughing mill and finishing mill.

In this example, the simultaneous rolling of a total of three products increases the production capacity by about 37%.

LIST OF REFERENCE NUMBERS

1 metal rolling stock
2 first zone (casting)
3 second zone

4 first rolling installation
5 third zone
6 second rolling installation
7 fourth zone
8 further processing installation
9 conveyance system
10 rolling stand (Steckel mill)
11 first furnace (Steckel hot box)
12 second furnace (Steckel hot box)
13 cooling installation
14 roller table
15 means for transverse conveyance
16 means for transverse conveyance
17 continuous casting installation
18 slab storage area
19 heating furnace
20 descaling system
21 shears
22 coiler
23 hot straightening machine
F direction of flow of the material

The invention claimed is:

1. Installation for producing rolled metal product (1), which has:

a first zone (2), in which slabs are produced by primary forming;

a second zone (3) downstream of the first zone (2) in the direction of flow (F) of the material, in which at least a first rolling installation (4) is installed for rolling the slabs;

a third zone (5) downstream of the second zone (3) in the direction of flow (F) of the material, in which at least a second rolling installation (6) is installed for rolling the slabs or the intermediate product produced from them; and a fourth zone (7) downstream of the third zone (5) in the direction of flow (F) of the material, in which at least one installation (8) for further processing of the rolled material is installed, comprising a conveyance system (9) with which the metal stock (1) can be removed between the second zone (3) and the third zone (5) transversely to the direction of flow, conveyed on a rolling table parallel to the direction of flow, and then returned to the treatment process between the third zone (5) and the fourth zone (7) transversely to the direction of flow.

2. Installation in accordance with claim 1, wherein second rolling installation (6) is a Steckel mill, which has at least one rolling stand (10) with a first hot box (11) upstream and a second hot box (12) downstream of the stand in the direction of flow (F) of the metal rolling stock (1).

3. Installation in accordance with claim 2, wherein a shear (21) is installed downstream of the second hot box (12) in the direction of flow (F) of the metal rolling stock (1).

4. Installation in accordance with claim 1, wherein the further processing installation (8) comprises a cooling installation (13) for the rolled product (1).

5. Installation in accordance with claim 1, wherein the conveyance system (9) has a roller table (14) that is arranged parallel to the second rolling installation (6).

6. Installation in accordance with claim 1, wherein the conveyance system (9) has at least one and preferably two devices (15, 16) with which metal rolling stock (1) can be conveyed transversely to the direction of flow (F) of the material.

7. Installation in accordance with claim 1, wherein the first zone (2) has a continuous casting installation (17).

8. Installation in accordance with claim 1, wherein a slab storage area (18) is located in the first zone (2) or in the second zone (3) of the installation.

9. Installation in accordance with claim 8, wherein at least one heating furnace (19) is arranged between the slab storage area (18) and the first rolling installation (4).

10. Installation in accordance with claim 9, wherein a descaling system (20) is installed between the one or more heating furnaces (19) and the first rolling installation (4).

* * * * *